US008154375B2

(12) United States Patent
Chen

(10) Patent No.: US 8,154,375 B2
(45) Date of Patent: Apr. 10, 2012

(54) OVERCURRENT PROTECTION DEVICE HAVING TRIP FREE MECHANISM

(76) Inventor: Tsan-Chi Chen, Chung Ho (TW)

( * ) Notice: Subject to any disclaimer, the term of this patent is extended or adjusted under 35 U.S.C. 154(b) by 266 days.

(21) Appl. No.: 12/574,976

(22) Filed: Oct. 7, 2009

(65) Prior Publication Data

US 2011/0080250 A1 Apr. 7, 2011

(51) Int. Cl.
*H01H 71/16* (2006.01)
*H01H 13/14* (2006.01)
*H01H 3/02* (2006.01)

(52) U.S. Cl. ..... 337/74; 337/75; 337/66; 200/341

(58) Field of Classification Search ..... 337/66, 337/74, 75; 200/341
See application file for complete search history.

(56) References Cited

U.S. PATENT DOCUMENTS 3,435,169 A * 3/1969 Bienwald et al. ..... 200/315
3,617,971 A * 11/1971 Ellenberger ..... 337/66
3,832,667 A * 8/1974 Blanton ..... 337/354
4,000,444 A * 12/1976 Douglas et al. ..... 361/45
4,117,443 A * 9/1978 Hofsass ..... 337/348
4,118,683 A * 10/1978 Schwarz ..... 337/91
4,345,233 A * 8/1982 Matthies ..... 337/75
4,736,081 A * 4/1988 Sorrells ..... 200/525
5,264,817 A * 11/1993 Sorenson ..... 337/68
5,453,725 A * 9/1995 You et al. ..... 337/68
5,541,569 A * 7/1996 Jang ..... 337/68
5,685,481 A * 11/1997 Murphy et al. ..... 236/21 B
5,854,585 A * 12/1998 Kingma ..... 337/367
6,094,126 A * 7/2000 Sorenson ..... 337/37
6,275,134 B1 * 8/2001 Chen ..... 337/37
6,335,674 B1 * 1/2002 Huang ..... 337/37
6,400,250 B1 * 6/2002 Wang ..... 337/66
6,570,480 B1 * 5/2003 Huang ..... 337/79
6,577,221 B1 * 6/2003 Wang ..... 337/59
6,617,952 B1 * 9/2003 Yu ..... 337/94
6,664,884 B1 * 12/2003 Yu ..... 337/59
6,734,779 B2 * 5/2004 Yu ..... 337/59
6,876,290 B2 * 4/2005 Yu ..... 337/59
7,248,140 B2 * 7/2007 Yu ..... 337/94
7,283,031 B2 * 10/2007 Huang ..... 337/66
7,304,560 B2 * 12/2007 Yu ..... 337/94
7,307,506 B2 * 12/2007 Yu ..... 337/94
7,317,375 B2 * 1/2008 Yu ..... 337/94
7,583,175 B2 * 9/2009 Yu ..... 337/59
7,656,268 B2 * 2/2010 Yu ..... 337/59
7,688,174 B2 * 3/2010 Hung ..... 337/66
2003/0160679 A1 * 8/2003 Yu ..... 337/37
2004/0036570 A1 * 2/2004 Yu ..... 337/59
2006/0176141 A1 * 8/2006 Yu ..... 337/66

* cited by examiner

*Primary Examiner* — Bradley Thomas
(74) *Attorney, Agent, or Firm* — Bacon & Thomas PLLC

(57) ABSTRACT

This invention relates to an overcurrent protection device, which comprises a housing having a first side mounted with first and second wire terminals and a second side installed with a button, an elastic element installed therein for abutting against the button, a memory alloy plate disposed therein and having a first end connected to the first wire terminal and a free end having a first contact, and an elastic metal sheet having two ends movably connected to the first and free ends respectively. When the button is pressed, an extended rod thereof can push the first contact and cause the memory alloy plate to be deformed for enabling the first contact to contact a second contact on the second wire terminal. When the button is released and shifted away from the first contact, a space will be provided for the first contact to return an original status prior to deformation.

11 Claims, 6 Drawing Sheets

OVERCURRENT PROTECTION DEVICE HAVING TRIP FREE MECHANISM

FIELD OF THE INVENTION

The present invention relates to an overcurrent protection device, more particularly to an overcurrent protection device having a trip free mechanism for preventing the overcurrent protection device from being overheated and avoiding contacts thereof from being unable to be separated with each other.

BACKGROUND OF THE INVENTION

Referring to FIG. 1, a traditional overcurrent protection device 1 is illustrated and comprises a housing 10, a button 11, a first wire terminal 12 and a second wire terminal 13, wherein the button 11 is disposed in a hole 100 of the housing 10. An upper surface of the button 11 is exposed out of the housing 10, while a lower side surface of the button 11 is extended to form a blocking plate 110 which is made of heatproof insulated bakelite material. A spring 15 is sandwiched between a lower end of the button 11 and an inner lower edge of the hole 100. Each of the first wire terminal 12 and the second wire terminal 13 is mounted in the housing 10, respectively. One end of each of the first wire terminal 12 and the second wire terminal 13 is protruded out of the housing 10. Furthermore, the overcurrent protection device 1 further comprises a memory alloy plate 14, wherein one end of the memory alloy plate 14 is connected to the other end of the first wire terminal 12. The other end of the memory alloy plate 14 is provided with a first contact 16 close to an end edge thereof, while the other end of the second wire terminal 13 is provided with a second contact 17 corresponding to the first contact 16. Before the temperature of the memory alloy plate 14 is up to a predetermined temperature, the memory alloy plate 14 is in a bent status, so that the other end of the memory alloy plate 14 is at a position close to the second wire terminal 13.

Therefore, when the overcurrent protection device 1 is in a close mode, the button 11 is forced by the elastic force of the spring 15, so that the blocking plate 110 is sandwiched between the first contact 16 and the second contact 17 to exactly block the electrical conduction therebetween. Then, when the upper surface of the button 11 is pressed to move downward the blocking plate 110, the bent status of the memory alloy plate 14 causes the contact between the first contact 16 and the second contact 17, so that the electrical conduction therebetween is finished. At this time, the overcurrent protection device 1 is switched into an open mode, and the blocking plate 110 is engaged below the first contact 16 and the second contact 17 due to the tight contact between the first contact 16 and the second contact 17. Thus, the button 11 can not move upward based on the elastic force of the spring 15. However, when the current is suddenly raised over a predetermined loading value, and makes the temperature of the memory alloy plate 14 go beyond the predetermined temperature, the other end of the memory alloy plate 14 will deform to reversely bend from the original bent status toward the second wire terminal 13 due to the thermal memory effect, so that the first contact 16 and the second contact 17 will be separated from each other to form a close circuit for switching off the electric power. At this time, because the blocking plate 110 is not engaged below the first contact 16 and the second contact 17, the button 11 can smoothly move upward based on the elastic force of the spring 15. Thus, the blocking plate 110 can return to be sandwiched between the first contact 16 and the second contact 17, so as to prevent the overcurrent protection device 1, wires and related appliances connected thereto from repeatedly receiving the overcurrent over the predetermined loading value due to the recovered bent status of the memory alloy plate 14 after the temperature is lowered. Therefore, the overcurrent protection device 1, wires and related appliances connected thereto can be efficiently protected from possible damage or sparking danger, so that the operational safety of the overcurrent protection device 1 and the appliances can be efficiently enhanced.

However, referring still to FIG. 1, there are still several disadvantages existing in the actual operation of the overcurrent protection device 1, as follows:

(1) When the current is suddenly raised to increase the temperature of the memory alloy plate 14 and deform the memory alloy plate 14 to separate the first contact 16 and the second contact 17, the blocking plate 110 must return to be sandwiched between the first contact 16 and the second contact 17, in order to efficiently prevent the overcurrent protection device 1, wires and related appliances connected thereto from repeatedly receiving the overcurrent over the predetermined loading value. However, because the separation distance of the first contact 16 and the second contact 17 is deformed according to the influence of the temperature of the memory alloy plate 14, the thickness design of the blocking plate 110 for separating the first contact 16 from the second contact 17 is important. If the blocking plate 110 is excessively thick, the blocking plate 110 may not smoothly return to be sandwiched between the first contact 16 and the second contact 17 due to excessively small separation distance of the first contact 16 and the second contact 17 when the current is suddenly raised to heat and deform the memory alloy plate 14 to separate the first contact 16 and the second contact 17, resulting in causing the overcurrent protection device 1, wires and related appliances connected thereto to repeatedly receive the overcurrent over the predetermined loading value. In addition, if the blocking plate 110 is excessively thin, the blocking plate 110 may be easily broken, resulting in losing the protection function of the overcurrent protection device 1. As a result, the overcurrent protection device 1 can not smoothly finish the protection measure of power interruption when the current is overloaded.

(2) When the current is suddenly raised, there are still some risks which may cause that the first contact 16 and the second contact 17 can not smoothly separate from each other. For example, when foreign objects are carelessly placed on the button 11 or when the gap between the button 11 and the housing 10 is filled with dirt over years, the button 11 may difficultly be moved. As a result, the button 11 can not be smoothly moved upward based on the elastic force of the spring 15 for returning the blocking plate 110 to be sandwiched between the first contact 16 and the second contact 17. Therefore, when the current is overloaded under a contact status of the first contact 16 and the second contact 17, the temperature of the memory alloy plate 14 will be raised, and the memory alloy plate 14 will deform to separate the first contact 16 from the second contact 17. Then, after the temperature of the memory alloy plate 14 is lowered under the separation status of the first contact 16 and the second contact 17, the first contact 16 and the second contact 17 will return to contact each other. As a result, not only do the overcurrent protection device 1, wires and related appliances connected thereto repeatedly receive the overcurrent over the predetermined loading value, but also some electric arc may occur between the first contact 16 and the second contact 17 due to the inexact insulation therebetween, resulting in damaging the overcurrent protection device 1, wires and related appliances connected thereto or causing fire accident due to arc sparking.

As a result, it is important for related manufacturers of designing and manufacturing overcurrent protection devices having a trip free mechanism to think how to develop a new overcurrent protection device having a trip free mechanism to solve the foregoing serious disadvantages of the traditional overcurrent protection device.

It is therefore tried by the inventor to develop an overcurrent protection device having a trip free mechanism to efficiently and smoothly separate a first contact from a second contact to automatically switch into an open mode for interrupting the electric power when the current is suddenly raised over the predetermined loading value.

BRIEF SUMMARY OF THE INVENTION

An object of the present invention is to provide an overcurrent protection device having a trip free mechanism. The overcurrent protection device comprises a housing, an elastic element, a memory alloy plate and an elastic metal sheet, wherein the housing has a first side mounted with a first wire terminal and a second wire terminal, and a second side having an opening installed with a button. The button has a lower surface provided with an extended rod on which the elastic element is sleeved. The elastic element has a first end abutting against the lower surface of the button, and a second end abutting against a stopping block formed on an inner side wall of the housing. The memory alloy plate is disposed in the housing, and has a first end connected to the first wire terminal and a free end having a first contact which is aligned with the extended rod, while the second wire terminal has a second contact aligned with the first contact. The elastic metal sheet has a first end movably connected to a position of the memory alloy plate close to the first end thereof, and a second end movably connected to an end edge of the free end of the memory alloy plate. When the button is pressed, the extended rod can push the first contact, so that the free end is shifted to overcome a critical deformation stress of the free end for triggering the free end to deform. Thus, the first contact can contact the second contact, and the first wire terminal will be electrically connected to the second wire terminal. At this time, because the elastic element is compressed between the button and the stopping block, an elastic force accumulated by the compression of the elastic element will be released when the button is released. Thus, the button will be shifted away from the first contact to provide a space for the free end to return an original status prior to deformation of the memory alloy plate. When the temperature of the memory alloy plate is over a predetermined temperature due to the overload of the current passing through the memory alloy plate, the free end will return to the un-deformation status due to the thermal memory effect, so that the first contact will be separated from the second contact to form an open mode. As a result, such configuration efficiently prevents the accident caused by the problem that the overcurrent protection device is overheated and the first contact can not be separated from the second contact. Therefore, the safety of the overcurrent protection device can be substantially enhanced, while the related manufacturers can fabricate highly safe overcurrent protection devices with lower design costs.

BRIEF DESCRIPTION OF THE SEVERAL VIEWS OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
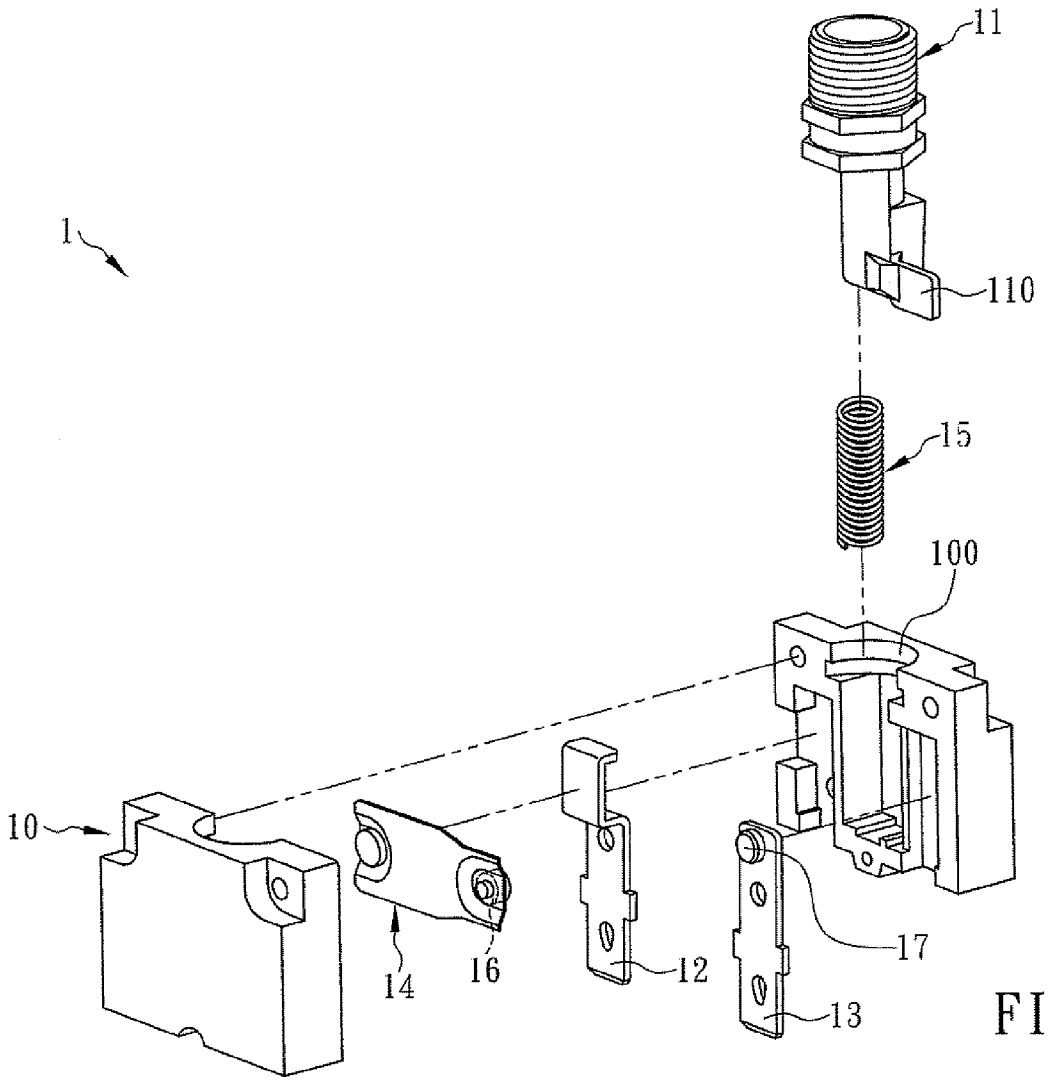
FIG. 1 (Prior Art)
FIG. 1 is an exploded perspective view of a traditional overcurrent protection device.
Figure 2:
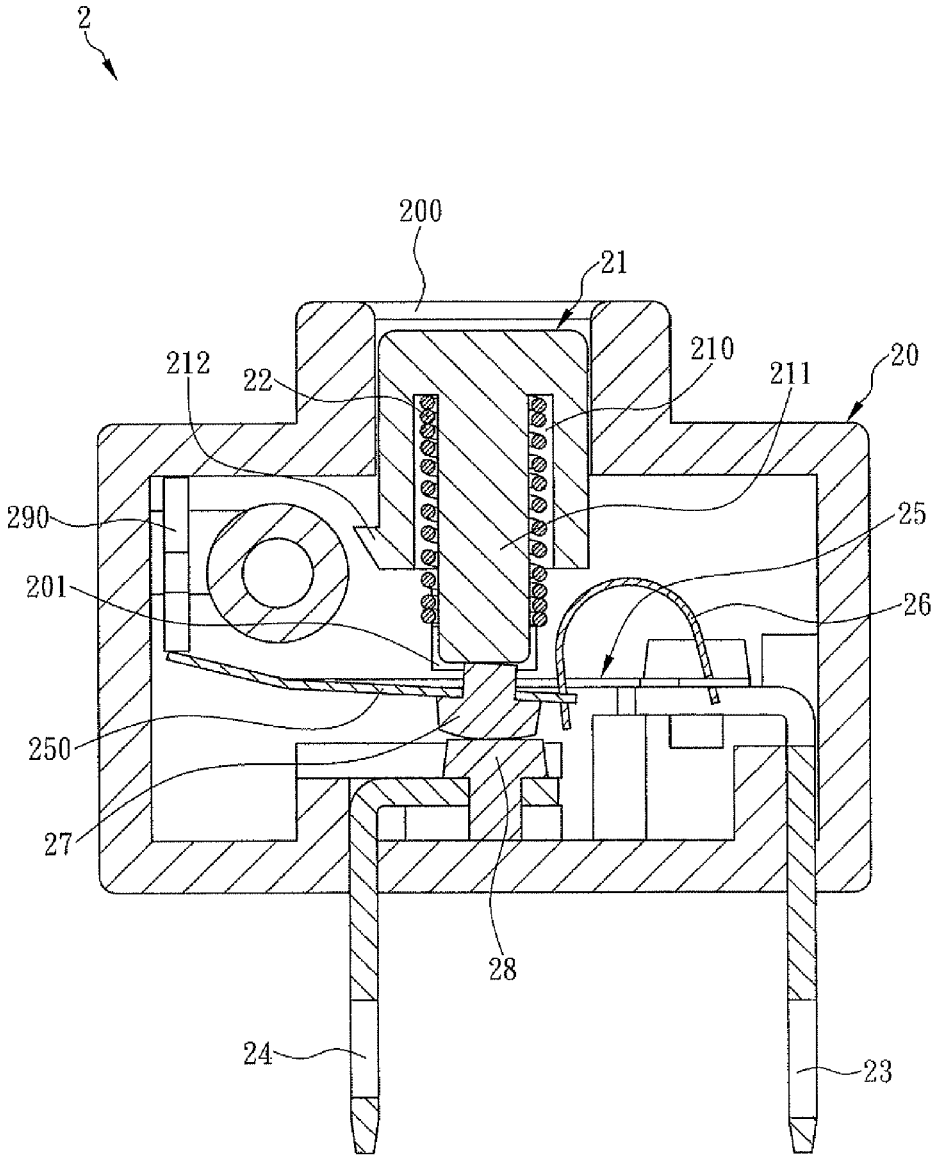
FIG. 2 is a cross-sectional view of an overcurrent protection device having a trip free mechanism according to a preferred embodiment of the present invention.

The present invention is an overcurrent protection device having a trip free mechanism. Referring now to FIG. 2, the overcurrent protection device 2 comprises a housing 20, a button 21, an elastic element 22, a first wire terminal 23, a second wire terminal 24, a memory alloy plate 25 and an elastic metal sheet 26, wherein the button 21 fits within an inner periphery of an opening 200 of the housing 20, and the button 21 has a lower surface formed with a receiving space 210 which receives therein an extended rod 211. The extended rod 211 has a first end connected to the lower surface of the button 21, while the length of the extended rod 211 is greater than that of a peripheral wall of the button 21. The elastic element 22 is sleeved on the extended rod 211. The elastic element 22 has a first end abutting against the lower surface of the button 21, and a second end abutting against a stopping block 201 formed on an inner side wall of the housing 20. The first wire terminal 23 and the second wire terminal 24 are mounted on positions corresponding to the position of the button 21 in the housing 20, respectively. Each of the first wire terminal 23 and the second wire terminal 24 has a first end protruding out of the housing 20, respectively. The first wire terminal 23 has a second end connected to a first end of the memory alloy plate 25. The memory alloy plate 25 is further formed with a free end 250 having a first contact 27 at a position close to an end edge of the free end 250, while the first contact 27 is aligned with the extended rod 211. The second wire terminal 24 has a second end provided with a second contact 28 aligned with the first contact 27. The elastic metal sheet 26 is U-shaped, and has a first end movably connected to a position of the memory alloy plate 25 close to the first end thereof, and a second end movably connected to the end edge of the free end 250 of the memory alloy plate 25.

Figure 3:
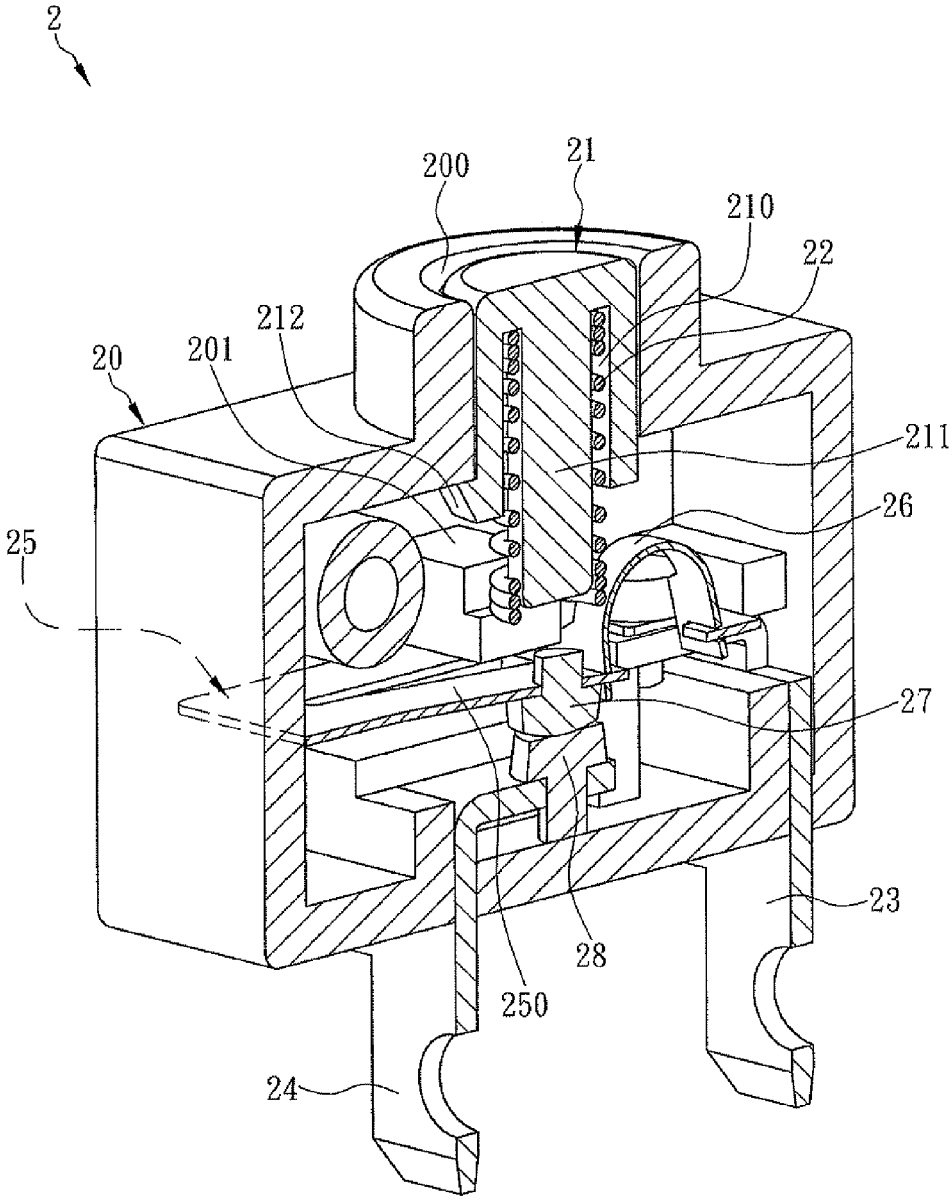
FIG. 3 is a perspective cross-sectional view of the overcurrent protection device having the trip free mechanism according to the preferred embodiment of the present invention.
Figure 4:
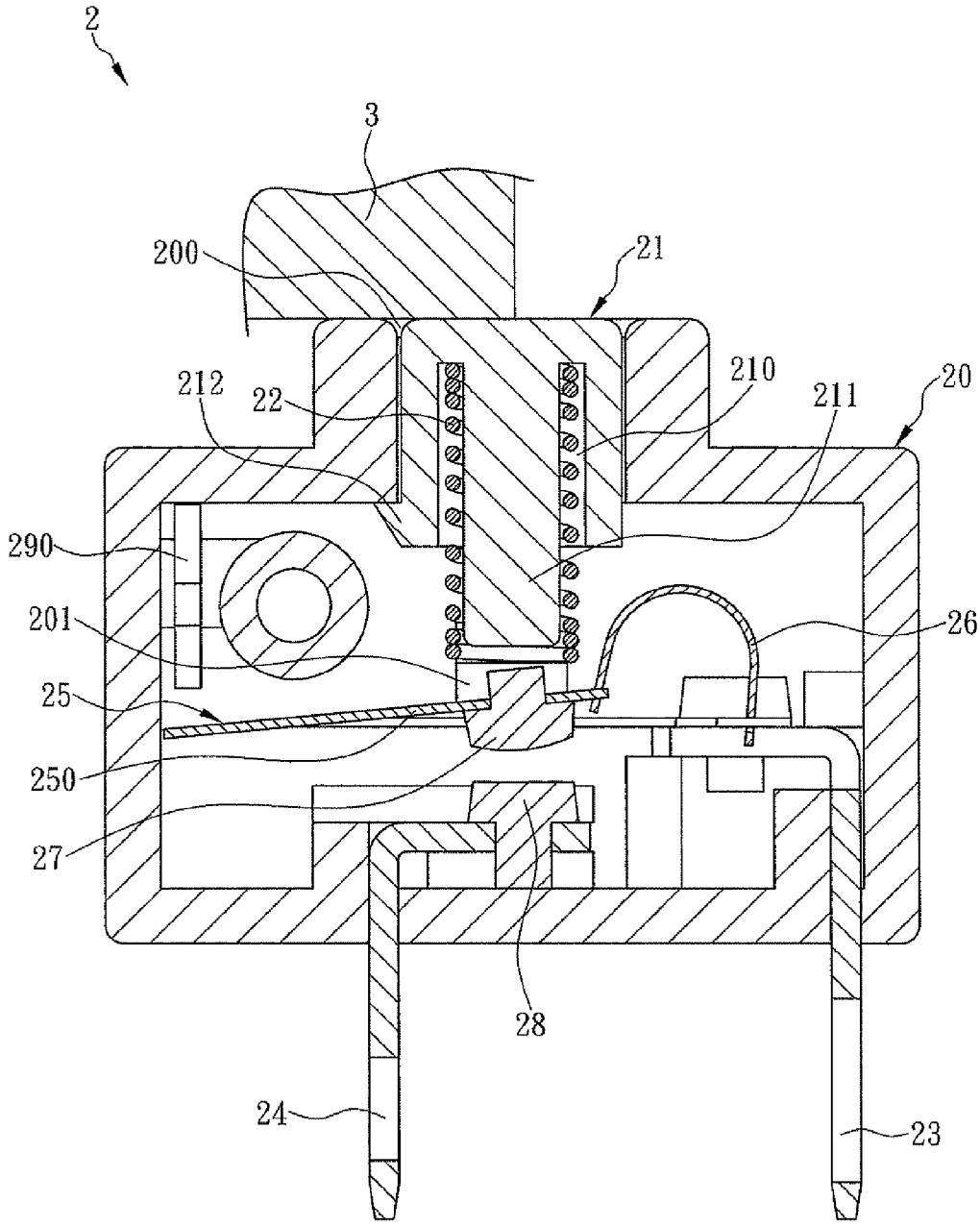
FIG. 4 is another cross-sectional view of the overcurrent protection device having the trip free mechanism according to the preferred embodiment of the present invention.

Therefore, when an upper surface of the button 21 is pressed by a user, a second end of the extended rod 211 can push the first contact 27, so that the free end 250 is shifted to overcome a critical deformation stress of the free end 250 for triggering the free end 250 to deform. Thus, the first contact 27 can contact the second contact 28, and the first wire terminal 23 will be electrically connected to the second wire terminal 24. At this time, referring now to FIG. 3, because the elastic element 22 is compressed between the button 21 and the stopping block 201, an elastic force accumulated by the compression of the elastic element 22 will be released when the button 21 is released. Thus, the button 21 will be shifted away from the first contact 27 to separate the second end of the extended rod 211 from the first contact 27 and to provide a predetermined gap between the extended rod 211 and the first contact 27, so as to provide a space for the free end 250 to return an original status prior to deformation of the memory alloy plate 25. Referring now to FIG. 4, even when the upper surface of the button 21 of the overcurrent protection device 2 is pressed by a foreign object 3 (or when a gap between the button 21 and the housing 20 is filled with dirt over years) to difficultly move the button 21, the free end 250 still can return to the original status prior to its deformation based on the thermal memory effect when the temperature of the memory alloy plate 25 is over a predetermined temperature due to the overload of the current passing through the memory alloy plate 25. Thus, the first contact 27 will be separated from the second contact 28 to form an open mode. As a result, such configuration efficiently prevents the accident caused by the problem that the overcurrent protection device 2 is overheated and the first contact 27 can not be separated from the second contact 28. Therefore, the safety of the overcurrent protection device 2 can be substantially enhanced, while the related manufacturer can fabricate highly safe overcurrent protection devices 2.

In the preferred embodiment of the present invention, referring back to FIG. 2, the overcurrent protection device 2 further comprises a retaining element 290 which is provided in the housing 20 and corresponding to a position above a second end of the memory alloy plate 25. In a case that the upper surface of the button 21 is pressed to trigger the deformation of the free end 250 to contact the first contact 27 and the second contact 28, the second end of the memory alloy plate 25 is reversely deformed opposite to the deformation direction of the free end 250. At this time, the retaining element 290 can abut against the second end of the memory alloy plate 25 to limit the deformation caused by the second end of the memory alloy plate 25. As a result, in a case that the temperature of the memory alloy plate 25 is over a predetermined temperature due to the overload of the current passing through the memory alloy plate 25, the deformation of the free end 250 can be simultaneously inhibited because the deformation of the second end of the memory alloy plate 25 is limited. Thus, the free end 250 can sensitively and smoothly return to the original status prior to deformation thereof based on the thermal memory effect, so that the first contact 27 will be exactly separated from the second contact 28 to form an open mode. As a result, such configuration efficiently prevents the accident caused by the problem that the overcurrent protection device 2 is overheated and the first contact 27 can not be separated from the second contact 28. Therefore, the safety of the overcurrent protection device 2 can be substantially enhanced.

Figure 5:
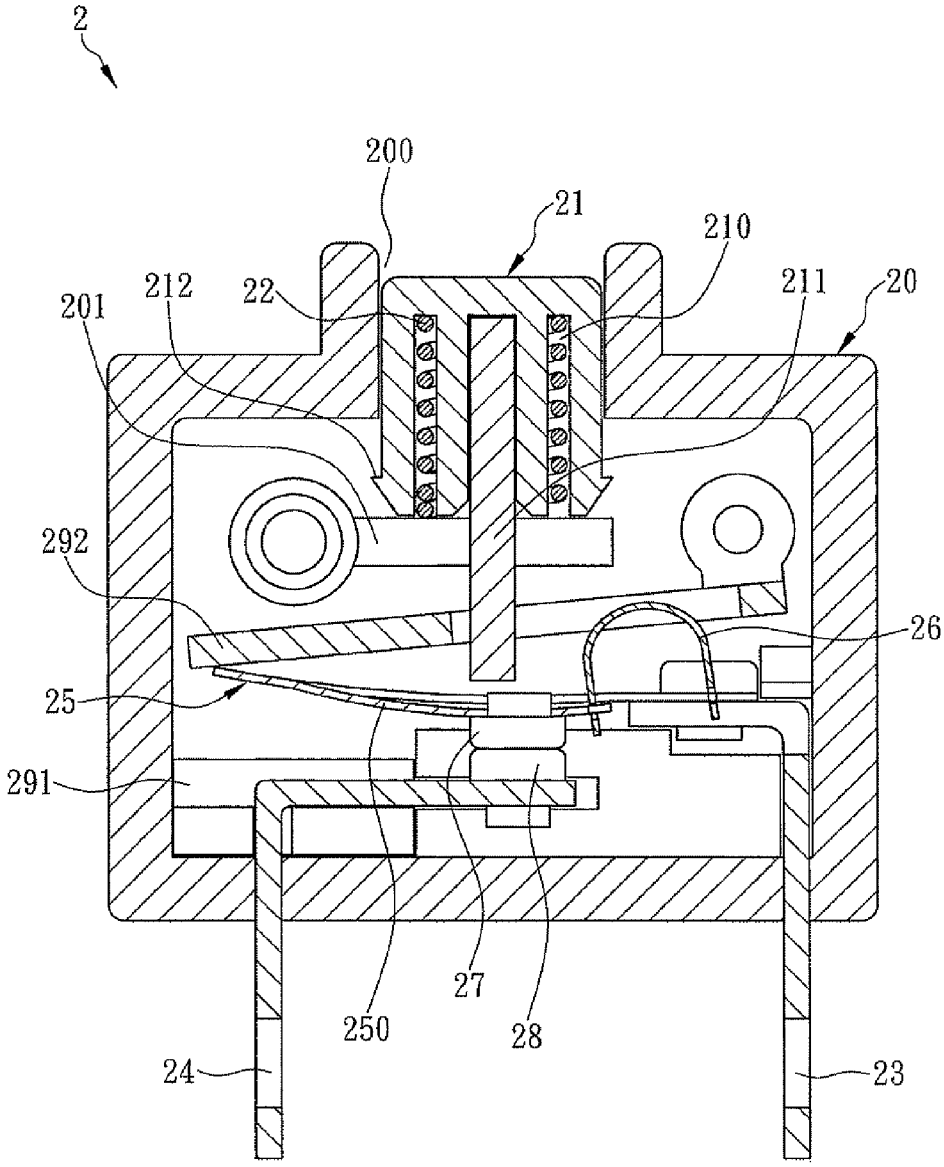
FIG. 5 is a cross-sectional view of an overcurrent protection device having a trip free mechanism according to another preferred embodiment of the present invention.
Figure 6:
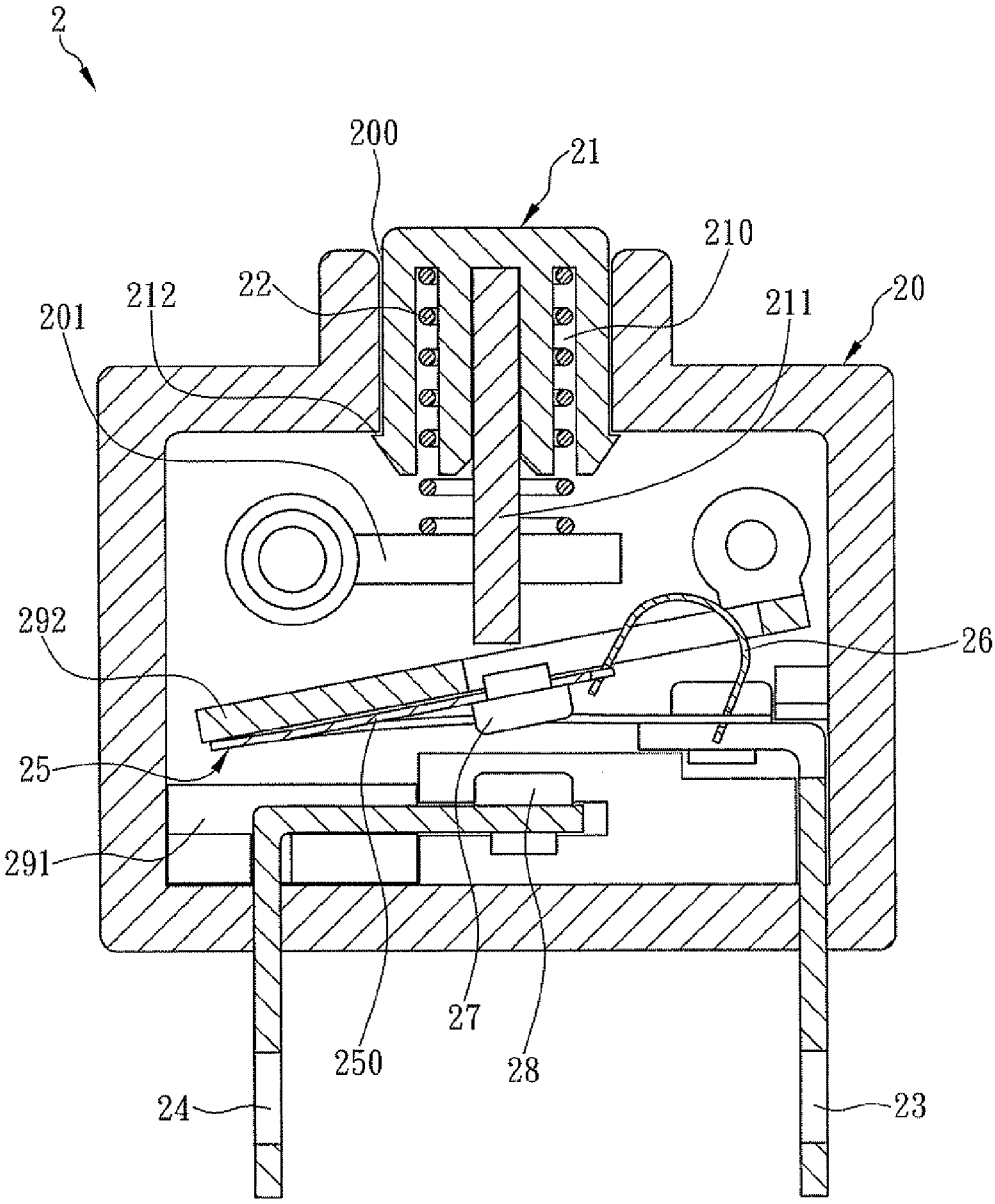
FIG. 6 is a cross-sectional view of the overcurrent protection device having the trip free mechanism of FIG. 5.

In another preferred embodiment of the present invention, referring back to FIGS. 5 and 6, the overcurrent protection device 2 further comprises a first pressing element 291 and a second pressing element 292, wherein the first pressing element 291 is mounted on the second end of the second wire terminal 24 and corresponding to a position below the second end of the memory alloy plate 25. The second pressing element 292 has a first end pivotally connected to a position close to the second end of the first wire terminal 23 in the housing 20, and a second end extended to align with a position above the second end of the memory alloy plate 25. In a case that the upper surface of the button 21 is pressed to trigger the deformation of the free end 250 to contact the first contact 27 and the second contact 28, the second end of the memory alloy plate 25 will be reversely deformed opposite to the deformation direction of the free end 250, so as to push the second end of the second pressing element 292 to move upward. When the first wire terminal 23 and the second wire terminal 24 receive an external surge current (such as a huge current transmitted through metal lines, grounding lines or other lines when the electric power is in a short circuit or thundered), the surge current can transiently generate a magnetic field between the first pressing element 291 and the second pressing element 292, so that the second end of the second pressing element 292 can be attracted by the first pressing element 291 to move downward. As a result, the deformation of the second end of the memory alloy plate 25 will be inhibited by the second pressing element 292. Thus, in the case that the overcurrent protection device 2 receives the surge current, the second pressing element 292 presses the second end of the memory alloy plate 25 downwardly, so that the free end 250 is indirectly affected to transiently return to the original status prior to deformation itself. Therefore, the first contact 27 can be exactly separated from the second contact 28 to form an open mode. As a result, such configuration efficiently prevents the accident caused by the problem that the overcurrent protection device 2 is overheated and the first contact 27 can not be separated from the second contact 28. Therefore, the safety of the overcurrent protection device 2 can be substantially enhanced.

Furthermore, in the foregoing preferred embodiments of the present invention, referring back to FIG. 2, for smoothly separating the extended rod 211 from the first contact 27 when the button 21 is pressed and released by the user, the manufacturer generally fabricates the overcurrent protection device 2 with the elastic element 22 which must be able to generate a greater elastic force. Thus, in a case that there is no means preventing the button 21 from leaving the elastic element 22, the button 21 risks being ejected out of the housing 20 when pressed or released. Consequently, the overcurrent protection device 2 will lack the button 21 in its next use, or will need re-installation of the button 21. Hence, in the present invention, the peripheral wall of the button 21 is extended along a direction away from the extended rod 211 to form an engaging block 212 disposed on a position close to the end surface of the peripheral wall, wherein the engaging block 212 on the end surface of the peripheral wall of the button 21 can engage with an inner wall of the housing 20, as shown in FIG. 3. As a result, the engaging block 212 of the button 21 can efficiently prevent the button 21 from being ejected out of the housing 20 due to the greater elastic force of the elastic element 22, so as to solve the foregoing problem.

Therefore, as described above, referring to FIGS. 3 and 4 again, when the current is suddenly raised over the predetermined loading value and the upper surface of the button 21 is pressed by the foreign object 3 (or when the gap between the button 21 and the housing 20 is filled with dirt over years) to difficultly move the button 21, the overcurrent protection device 2 of the present invention mainly can efficiently and smoothly separate the first contact 27 from the second contact 28 to automatically switch into an open mode for interrupting the electric power. As a result, such configuration efficiently prevents the accident caused by the problem that the overcurrent protection device 2 is overheated and the first contact 27 can not be smoothly separated from the second contact 28. Therefore, the safety of the overcurrent protection device 2 can be substantially enhanced, while the related manufacturers can easily fabricate highly safe overcurrent protection devices 2 and efficiently save the manufacturing costs thereof.

The present invention has been described with the preferred embodiments thereof and it is understood that many changes and modifications to the described embodiments can be carried out without departing from the scope and the spirit of the invention that is intended to be limited only by the appended claims.

What is claimed is:

1. An overcurrent protection device having a trip free mechanism, the overcurrent protection device comprising:

a housing;

a button fitting inside an inner periphery of an opening of the housing, and having a receiving space formed therein and corresponding to a bottom end thereof, wherein the receiving space has an extended rod received therein, and the extended rod has a top end connected to the button;

an elastic element sleeved on the extended rod, and having a top end abutting against the button and a bottom end abutting against a stopping block formed on an inner wall of the housing;

a first wire terminal mounted in the housing, and having a first end protruding out of the housing;

a memory alloy plate having a first end connected to a second end of the first wire terminal, and a free end having a first contact at a position between the first end and a second end of the memory alloy plate, wherein the first contact is aligned with the extended rod, and wherein when the free end is forced by an external force to overcome a critical deformation stress of the free end, the free end is triggered to deform, and when the temperature of the memory alloy plate is over a predetermined temperature due to an overload of a current passing through the memory alloy plate, the free end returns to an original status prior to deformation based on a thermal memory effect;

a second wire terminal mounted in the housing, and having a first end protruding out of the housing and a second end provided with a second contact aligned with the first contact; and an elastic metal sheet having a first end movably connected to a position of the memory alloy plate close to the first end thereof, and a second end movably connected to an end edge of the free end of the memory alloy plate, wherein when a top surface of the button is pressed, a bottom end of the extended rod pushes the first contact, so that the free end is shifted to overcome a critical deformation stress of the free end for triggering the free end to deform, and the first contact contacts the second contact, while the first wire terminal is electrically connected to the second wire terminal, wherein the elastic element is compressed between the button and the stopping block, so that an elastic force accumulated by the compression of the elastic element is released when the button is released, and the button is shifted away from the first contact to separate the bottom end of the extended rod from the first contact and to provide a space for the free end to return the original status prior to deformation of the memory alloy plate, such that the free end returns to the original status prior to deformation based on the thermal memory effect to separate the first contact from the second contact when the temperature of the memory alloy plate is over the predetermined temperature due to the overload of the current passing through the memory alloy plate.

2. The overcurrent protection device having the trip free mechanism according to claim 1, wherein the overcurrent protection device further comprises a retaining element which is provided in the housing and corresponding to a position above the second end of the memory alloy plate, and wherein when the top surface of the button is pressed to trigger the deformation of the free end to contact the first contact and the second contact, the second end of the memory alloy plate is reversely deformed opposite to the deformation direction of the free end, so that the retaining element abuts against the second end of the memory alloy plate to limit the deformation caused by the second end of the memory alloy plate.

3. The overcurrent protection device having the trip free mechanism according to claim 2, wherein a length of the extended rod is greater than a length of a peripheral wall of the button.

4. The overcurrent protection device having the trip free mechanism according to claim 3, wherein the peripheral wall of the button is extended along a direction away from the extended rod to form an engaging block disposed on a position close to an end surface of the peripheral wall, so that the engaging block on the end surface of the peripheral wall of the button is retained in the housing.

5. The overcurrent protection device having the trip free mechanism according to claim 4, wherein the first wire terminal and the second wire terminal are mounted at positions corresponding to the position of the button.

6. The overcurrent protection device having the trip free mechanism according to claim 5, wherein the elastic metal sheet is U-shaped.

7. The overcurrent protection device having the trip free mechanism according to claim 1, wherein the overcurrent protection device further comprising:

a first pressing element mounted on the second end of the second wire terminal and corresponding to a position below the second end of the memory alloy plate; and a second pressing element having a first end pivotally connected to a position close to the second end of the first wire terminal in the housing, and a second end extended to align with a position above the second end of the memory alloy plate, wherein when the top surface of the button is pressed to trigger the deformation of the free end to contact the first contact and the second contact, the second end of the memory alloy plate is reversely deformed opposite to the deformation direction of the free end, so as to push the second end of the second pressing element to move upward, and when the first wire terminal and the second wire terminal receive an external surge current, the surge current transiently generates a magnetic field between the first pressing element and the second pressing element, so that the second end of the second pressing element is attracted by the first pressing element to move downward, and the deformation of the second end of the memory alloy plate is inhibited by the second pressing element, such that the free end is indirectly affected to transiently return to the original status prior to deformation itself, and the first contact is exactly separated from the second contact to form an open mode.

8. The overcurrent protection device having the trip free mechanism according to claim 7, wherein a length of the extended rod is greater than a length of a peripheral wall of the button.

9. The overcurrent protection device having the trip free mechanism according to claim 8, wherein the peripheral wall of the button is extended along a direction away from the extended rod to form an engaging block disposed on a position close to an end surface of the peripheral wall, so that the engaging block on the end surface of the peripheral wall of the button is retained in the housing.

10. The overcurrent protection device having the trip free mechanism according to claim 9, wherein the first wire terminal and the second wire terminal are mounted at positions corresponding to the position of the button.

11. The overcurrent protection device having the trip free mechanism according to claim 10, wherein the elastic metal sheet is U-shaped.

* * * * *